US007861628B2

(12) United States Patent
DePoi et al.

(10) Patent No.: US 7,861,628 B2
(45) Date of Patent: Jan. 4, 2011

(54) METHOD FOR CALIBRATING A WEB-CUTTER HAVING A CHIP-OUT CUTTER MODULE

(75) Inventors: Arthur H. DePoi, Brookfield, CT (US); John F. Pezzuti, Naugatuck, CT (US); John W. Sussmeier, Cold Spring, NY (US); Daniel J. Williams, Woodbury, CT (US)

(73) Assignee: Pitney Bowes Inc., Stamford, CO (US)

( * ) Notice: Subject to any disclaimer, the term of this patent is extended or adjusted under 35 U.S.C. 154(b) by 830 days.

(21) Appl. No.: 11/581,017

(22) Filed: Oct. 13, 2006

(65) Prior Publication Data

US 2008/0087148 A1 Apr. 17, 2008

(51) Int. Cl.
*B26D 1/00* (2006.01)
*B23Q 15/00* (2006.01)

(52) U.S. Cl. ..... 83/13; 83/37; 83/74; 83/286

(58) Field of Classification Search ..... 83/74, 83/286, 13, 73, 72, 76, 367–371, 76.8, 359, 83/365; 493/13, 17, 19, 22
See application file for complete search history.

(56) References Cited

U.S. PATENT DOCUMENTS 4,640,165 A * 2/1987 McMahon et al. ..... 83/346
4,781,090 A * 11/1988 Feldkamper et al. ..... 83/74
5,235,515 A * 8/1993 Ungpiyakul et al. ..... 700/125
5,365,815 A * 11/1994 Pfaff, Jr. ..... 83/154
5,452,632 A * 9/1995 Durr et al. ..... 83/13
5,639,335 A * 6/1997 Achilles et al. ..... 156/353
5,768,959 A * 6/1998 Lorenzo ..... 83/74
5,974,923 A * 11/1999 Rigby et al. ..... 83/76
6,220,134 B1 * 4/2001 Thiel et al. ..... 83/74

* cited by examiner

*Primary Examiner*—Boyer D Ashley
*Assistant Examiner*—Omar Flores-Sánchez
(74) *Attorney, Agent, or Firm*—Michael J. Cummings; Angelo N. Chaclas

(57) ABSTRACT

A calibration procedure is carried out for determining the displacement distance from a reference point to the center of the blade in a web cutter in a mail inserter. A photosensor is placed near the paper plane of the web cutter to sense a web edge at the reference point downstream or upstream from the blade. At the start of the calibration procedure, the blade is caused to cut the web for providing a web edge. The web edge is moved in a backward and forward motion over the photosensor a few times for determining the theoretical center position of the photosensor relative to the position where the web is cut by the blade. By taking into account the chip-out width, the displacement distance from the center of the photosensor to the center of the chip out blade can be determined.

5 Claims, 10 Drawing Sheets

METHOD FOR CALIBRATING A WEB-CUTTER HAVING A CHIP-OUT CUTTER MODULE

TECHNICAL FIELD

The present invention relates generally to a mail processing machine and, more particularly, to the input portion of a high speed inserter system in which individual sheets are cut from a continuous web of printed materials for use in mass-production of mail pieces.

BACKGROUND OF THE INVENTION

Inserter systems, such as those applicable for use with the present invention, are mail processing machines typically used by organizations such as banks, insurance companies and utility companies for producing a large volume of specific mailings where the contents of each mail item are directed to a particular addressee.

In many respects, the typical inserter system resembles a manufacturing assembly line. Sheets and other raw materials (other sheets, enclosures, and envelopes) enter the inserter system as inputs. Then, a variety of modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

The input stages of a typical inserter system are depicted in FIG. 1*a*. At the input end of the inserter system, rolls or stacks of continuous printed documents, called a web, are provided at a web supply and fed into a web cutter where the continuous web is cut into individual sheets. In some inserter systems, the input stages of an inserter also include a right-angle turn to allow the individual pages to change their moving direction before they are fed into the inserter system, as shown in FIG. 1*b*.

FIG. 2 illustrates the input stages of an inserter wherein the continuous web material is provided in a fanfold stack. As shown in FIG. 2, the continuous web material 5 is drawn out of a fanfold stack 2. Typically, sheets in the continuous web material 5 are linked by perforations so that the web material can be driven continuously by a web driver 100 into a web-cutting module 200. The web-cutting module 200 has a cutter 210, usually in a form of a guillotine cutting blade, to cut the web material 5 crosswise into separate sheets 8.

In some inserter systems, the web material 5 must be split into two side-by-side portions by a cutting device 212 as shown in FIG. 3. The cutting device 212 may be a stationary knife or a rotating cutting disc. After the web material 5 is split into two side-by-side portions, it is cut crosswise by the cutter 210 into pairs of sheets 8I and 8II. The sheets 8I and 8II move side-by-side toward a right angle turn device so that they can move in tandem into an inserter system (not shown).

In other mailing machines, the web-material 5 has a row of sprocket holes on each side of the web material so that the web can be driven by a tractor with pins or a pair of moving belts with sprockets. As shown in FIG. 4, a pair of cutting devices 214 are used to separate the side strips containing the holes from the web material 5 before the web material is cut crosswise by the cutter 210. Additionally, some mechanical devices (not shown) are used to remove the side strips before the web-material is fed into the cutter 210.

When a new roll or stack of web material is fed into the web cutter module 200, it is essential to adjust the cutter so that the web will be split into side-by-side portions at the correct location (FIG. 3) or the side strips will be cut at the correct locations (FIG. 4).

A fanfold stack of web material is perforated at each sheet length location to facilitate folding a large number of sheets into a compact stack. It is desirable to cut off the perforated edges so that the individual cut sheets will have clear edges. Cutters with the ability to cut off the perforated edges are referred to as having the chip-out capability. The cutter 220 as shown in FIG. 5 is an illustrated example of the cutters with the chip-out capability. The chip-out portion containing the perforation between adjacent sheets is referred to as a chip. It is a small width of paper cut transversely from the web material. Blades are commonly designed to accommodate the chip-out capability in the following chip-out widths: ⅛ of an inch, 7.8 mm, 1/16 of an inch and ¼ of an inch. In the United States, the ⅛ inch chip-out is most common, whereas the 7.8 mm chip-out is most common in Europe. In a ⅛ inch chip, the width of the chip on each side of perforation is only 1/16 of an inch. In a 1/16 inch chip, the width of the chip on each side of perforation is only 1/32 of an inch. The chip-out operation requires a high web position accuracy with respect to the blade.

The chip-out cutter 220 is depicted in the figures as two separate blade plates, with the chip-out region in between. It will be appreciated by those skilled in the art that a common alternative chip-out blade is comprised of a single plate having a width corresponding to the chip-out width. The two sharpened edges of the single plate serve to cut both sides of the chip-out as the blade is lowered in a scissoring action into a corresponding slot.

It is thus advantageous and desirable to provide a method and system to establish an accurate datum for the motion control system that locates the web for subsequent cutting.

SUMMARY OF THE INVENTION

In a web cutter having a chip-out blade to cut a web into sheets, the chip-out blade is configured to cut a portion of the web cross-wise to remove a perforation provided in a fanfold stack for folding. A photosensor is placed near the plane of the paper path of the web cutter to sense a web edge at a reference point downstream or upstream from the chip-out blade. The present invention provides a calibration procedure for determining the displacement distance from the reference point to the chip-out blade without the need of visually determining the center of the chip out blade. At the start of the calibration procedure, the chip out blade is caused to cut a portion of the web for providing a web edge. The web edge is moved toward the photosensor for causing the photosensor to change its state. The web edge is moved in a backward and forward motion a few times so as to determine the theoretical center of the photosensor and the web position at the theoretical center in relationship to the position where the web is cut by the chip-out blade. By taking into account the chip out width, one is able to determine the displacement distance from the theoretical center of the photosensor to the center of the chip out blade. As such, when loading a web having a perforation as the lead edge of the web onto the web cutter for cutting the web into sheets, it is required only to determine the position of the lead edge at the theoretical center of the photosensor by similar backward and forward movement of the leading edge over the photosensor. With this calculated position of the lead edge and the calibrated displacement distance, the perforation can be advanced to the center of the chip out blade for a chip out operation. With the known sheet length between perforations, subsequen7 perforations can be similarly removed.

DETAILED DESCRIPTION

Figure 5:
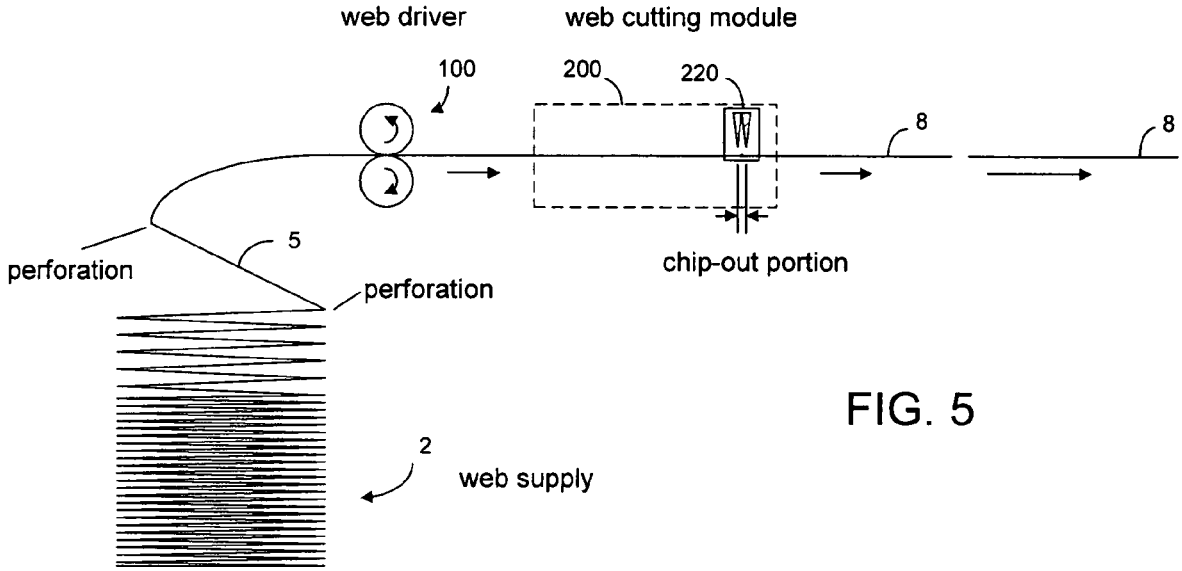
FIG. 5 is a schematic representation of a web cutter having chip-out capability.
Figure 6A:
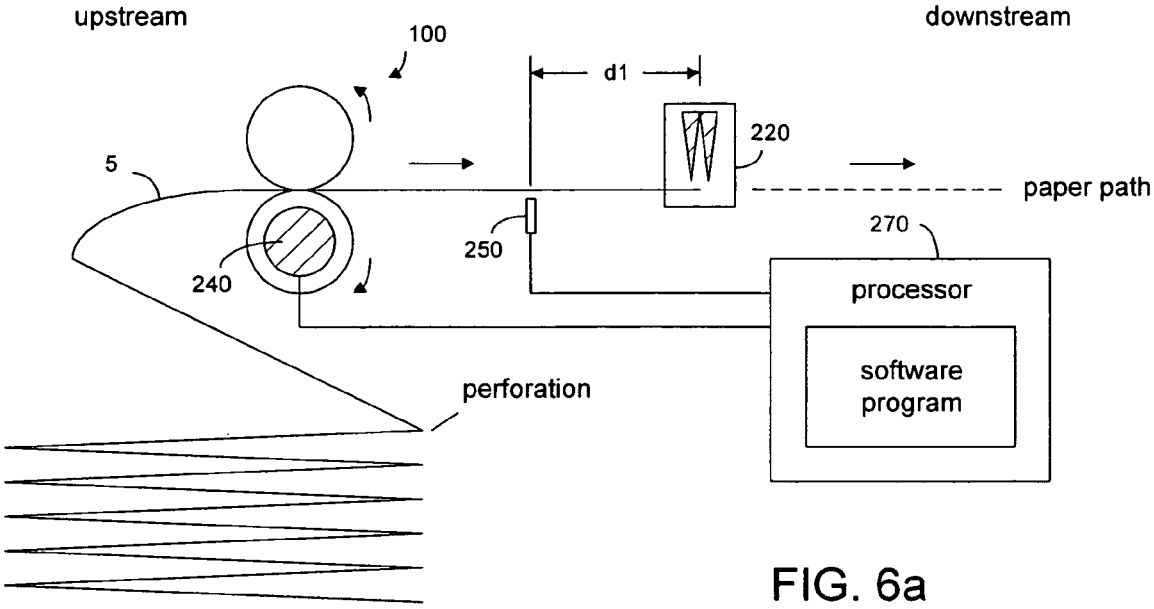
FIG. 6*a* is a schematic representation of a web cutter having means for establishing an accurate datum for the motion control system that locates the web for subsequent cutting, according to one embodiment of the present invention.
Figure 6B:
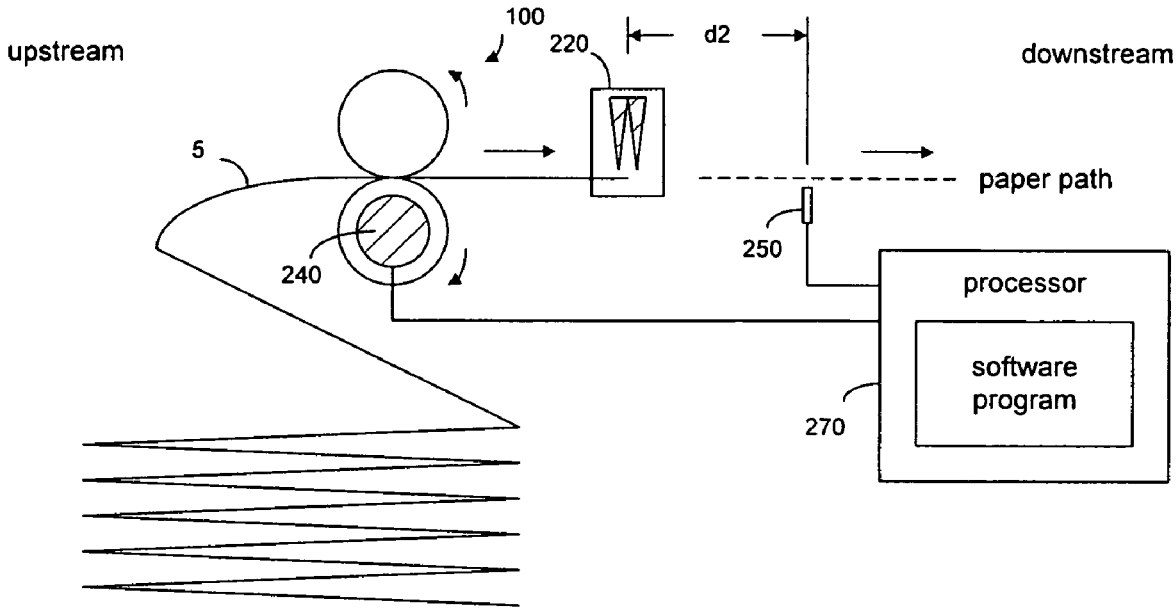
FIG. 6*b* is a schematic representation of a web cutter having means for establishing an accurate datum for the motion control system that locates the web for subsequent cutting, according to another embodiment of the present invention.

In an inserter system including a web cutter having the chip-out capability to cut off the perforated edge between adjacent sheets in a fanfold stack of material, the chip-out operation requires an accurate web position with respect to the blade of the cutter. As shown in FIGS. 6*a* and 6*b*, the cutter 220 has two blades separated by a distance equal to the chip-out portion of the web material (see FIG. 5). The chip-out width can be ⅛ of an inch, 7.8 mm, 1/16 of an inch, ¼ of an inch or any desirable width. It is essential that the web driver 100 moves the web material 5 accurately to place the perforation between adjacent sheets to the center of the chip-out blade.

Figure 6C:
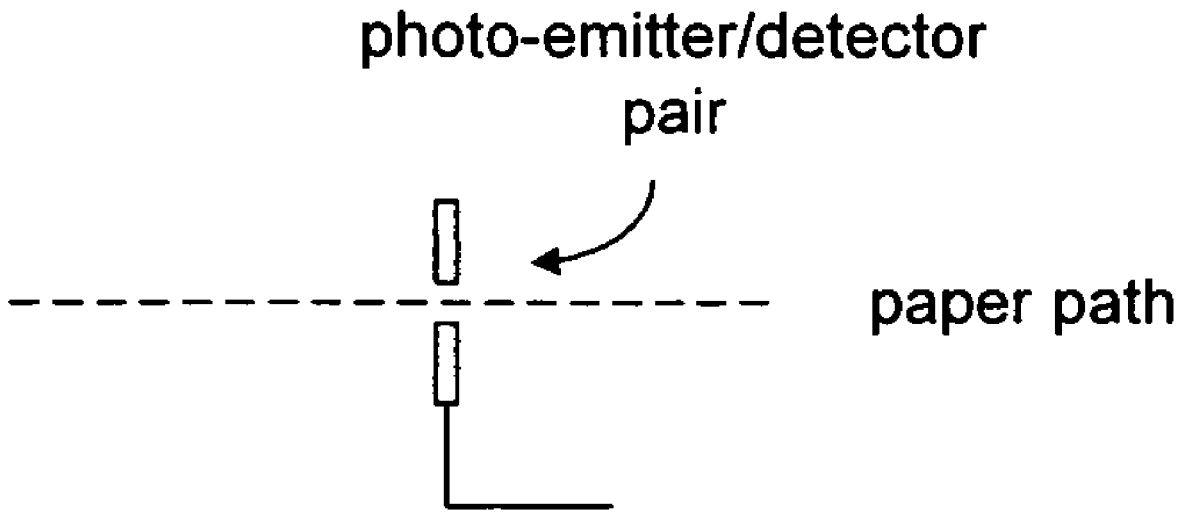
FIG. 6*c* is a schematic representation of a photosensor for establishing the datum for the motion control system, according to a different embodiment of the present invention.

In a web cutter as shown in FIGS. 6*a* and 6*b*, the present invention uses a sensor 250 as a reference point in a calibration process to control the movement of the web driver 100. Preferably, the sensor 250 is a photosensor. As depicted in FIGS. 6*a* and 6*b*, the photosensor is a reflection type in that both the photo-emitter and the photo-detector (not shown) are located on the same side of the plane of the paper path. The photo-detector will sense the passing of the edge of a web when the light beam emitted from the photo-emitter is reflected from the web material to the photo-detector. Preferably, the sensor 250 is placed below the plane of the paper path so that the sensor will not interfere with web loading or jam clearing. However, the sensor can be placed above the plane of the paper path. The photosensor can also be a through-beam type in that the photo-emitter and the photo-detector are located on different sides of the plane of the paper path to detect the passing of the web edge, as shown in FIG. 6*c*. The sensor 250 can also be a fiber-optic photosensing device, for example.

The sensor 250 may be located upstream from the blade of the cutter 220, as depicted in FIG. 6*a*, or downstream from the blade, as depicted in FIG. 6*b*. In either configuration, at the start of the calibration process the web is moved by the web driver 100 to place the web edge or a web perforation past the center of the blade, and cutter 200 cuts the web to provide a clean edge for calibration purposes. An encoder 240, which is linked to one of the rollers of the web driver 100, is used to provide the position of the clean edge for determining the position of the sensor 250 relative to the cutter 200. In FIG. 6*a*, the displacement of the sensor 250 from the cutter 220 downstream is denoted as d1. In FIG. 6*b*, the displacement of the sensor 250 from the cutter 200 upstream is denoted as d2. In either configuration, the web is moved in the direction of the sensor 250 in order to determine the displacement d1 or d2. Once the edge reaches the sensor 250, the web is moved forward and backward around the sensor position a number of times in order to obtain an accurate position of the sensor in relation to the cutter 220. As the web is moved forward and backward around the sensor position, a processor 270 reads the encoder value and records the lead edge position and trail edge position of the web edge as sensed by the sensor 250.

If a reflective sensor is used, the sensor is in a first state when there is no reflection from the paper above the sensor. The lead edge position is defined as when a web edge reaches the sensor, causing the sensor state to change from the first state to a second state. The trail edge position is defined as when a web edge moves away from the sensor, causing the sensor state to change from the second state to the first state. If the first state is ON, then the second state is OFF. If the first state is OFF, then the second state is ON. The web movement can be repeated several times with the encoder values stored in the processor 270. Once the values are stored, a software program in the processor 270 is used to average the lead and trail edge displacement events in order to minimize the effects of sensor hysteresis, if any. Performing this backward and forward movement of the web edge a number of times provides increased precision and accuracy for establishing the theoretical center of the sensor 250. Once this calibration procedure is completed, the web driver control system has accurate knowledge of the position of the sensor 250 with respect to the blade of the cutter 220. With this displacement calibration procedure, there is no need for an operator to visually find out where the center of the blade is.

With the known displacement d1 or d2 and the chip-out width, the web driver control system is able to move the web edge accurately from the sensor position to the center of the blade for cutting. With the length of the sheets also being known, the web driver control system can be programmed to advance the web for accurate chip-out operation.

Figure 1A:
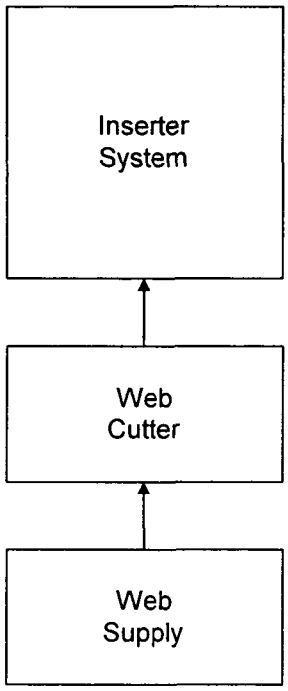
FIG. 1*a* is a block diagram illustrating a mailing machine having an inserter system, a web cutter and a web supply.
Figure 1B:
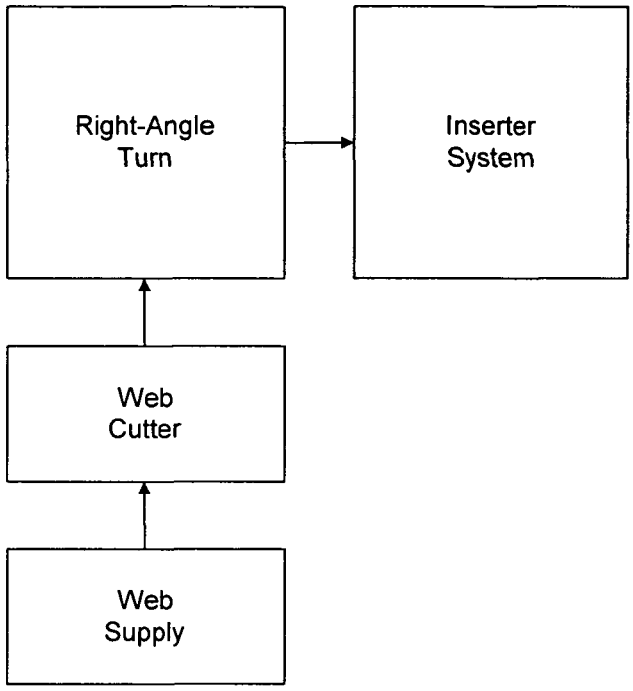
FIG. 1*b* is a block diagram illustrating a mailing machine wherein a right-angle turn module is positioned between an inserter system and a web cutter.
Figure 2:
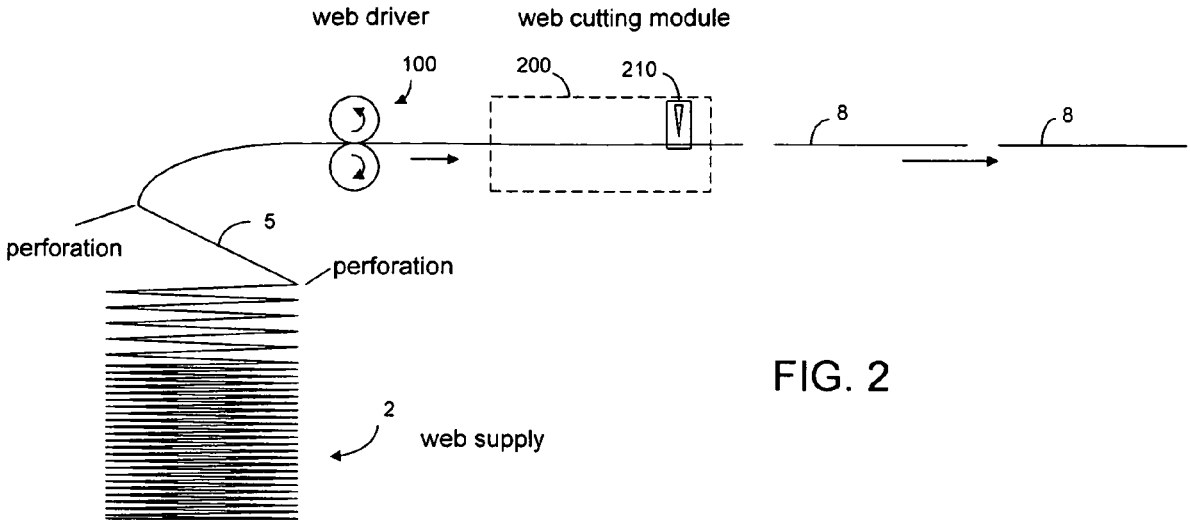
FIG. 2 is a schematic representation of a web cutter.
Figure 3:
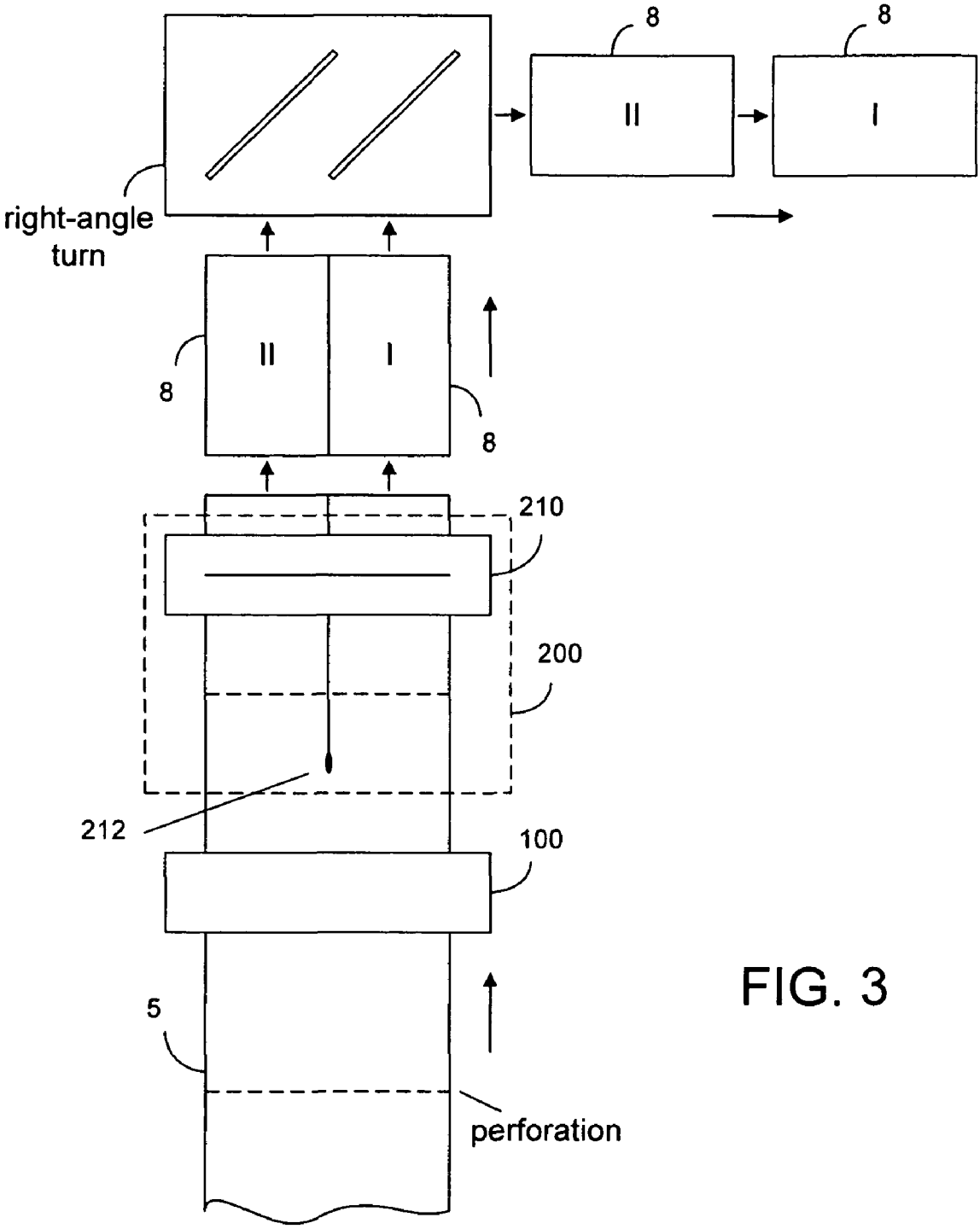
FIG. 3 is a schematic representation of a web cutter for splitting a web into two side-by-side portions before separating the web into individual sheets.
Figure 4:
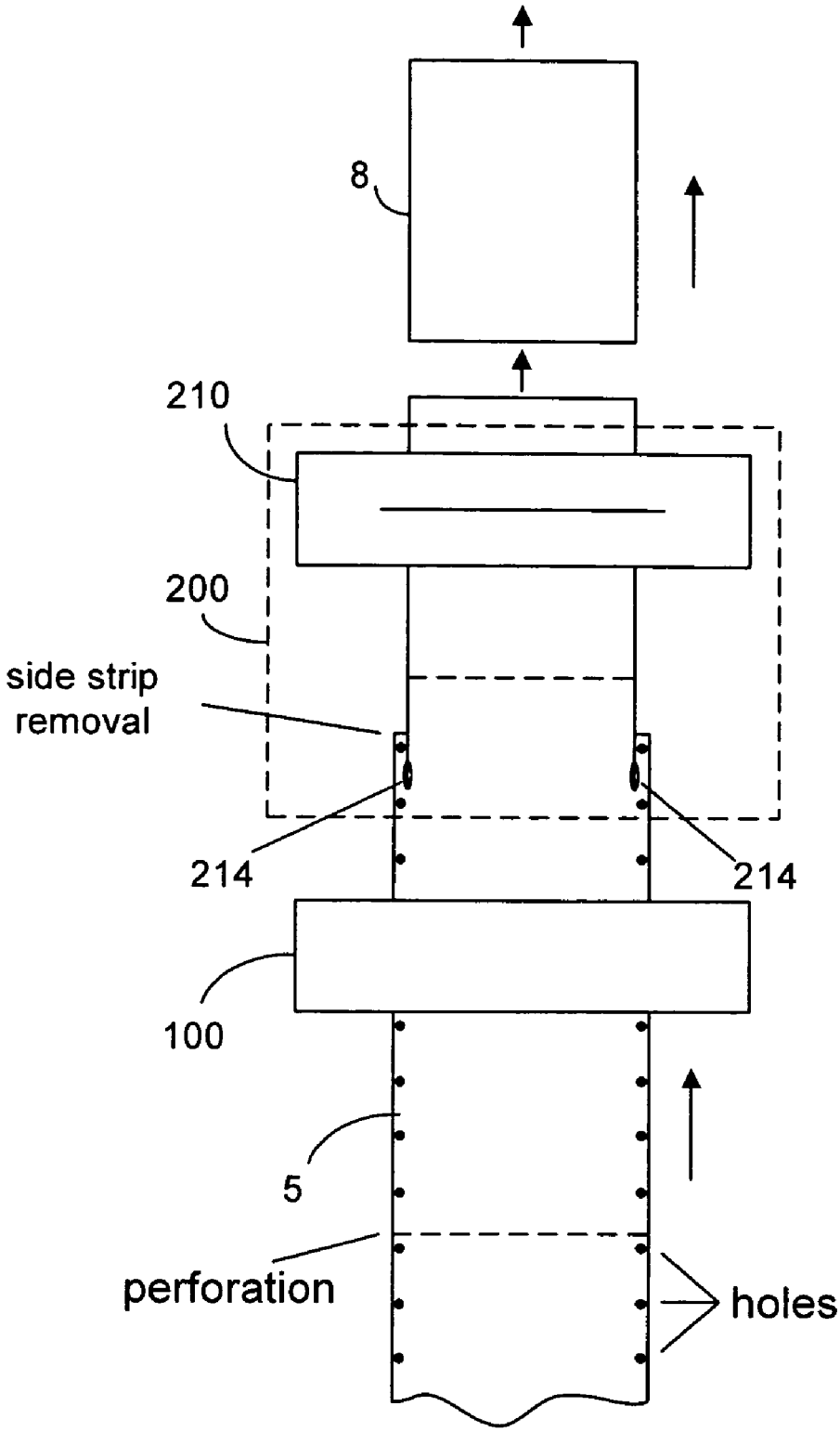
FIG. 4 is a schematic representation of a web cutter having two cutting devices to remove the side strips from a web before separating the web into individual sheets.
Figure 7:
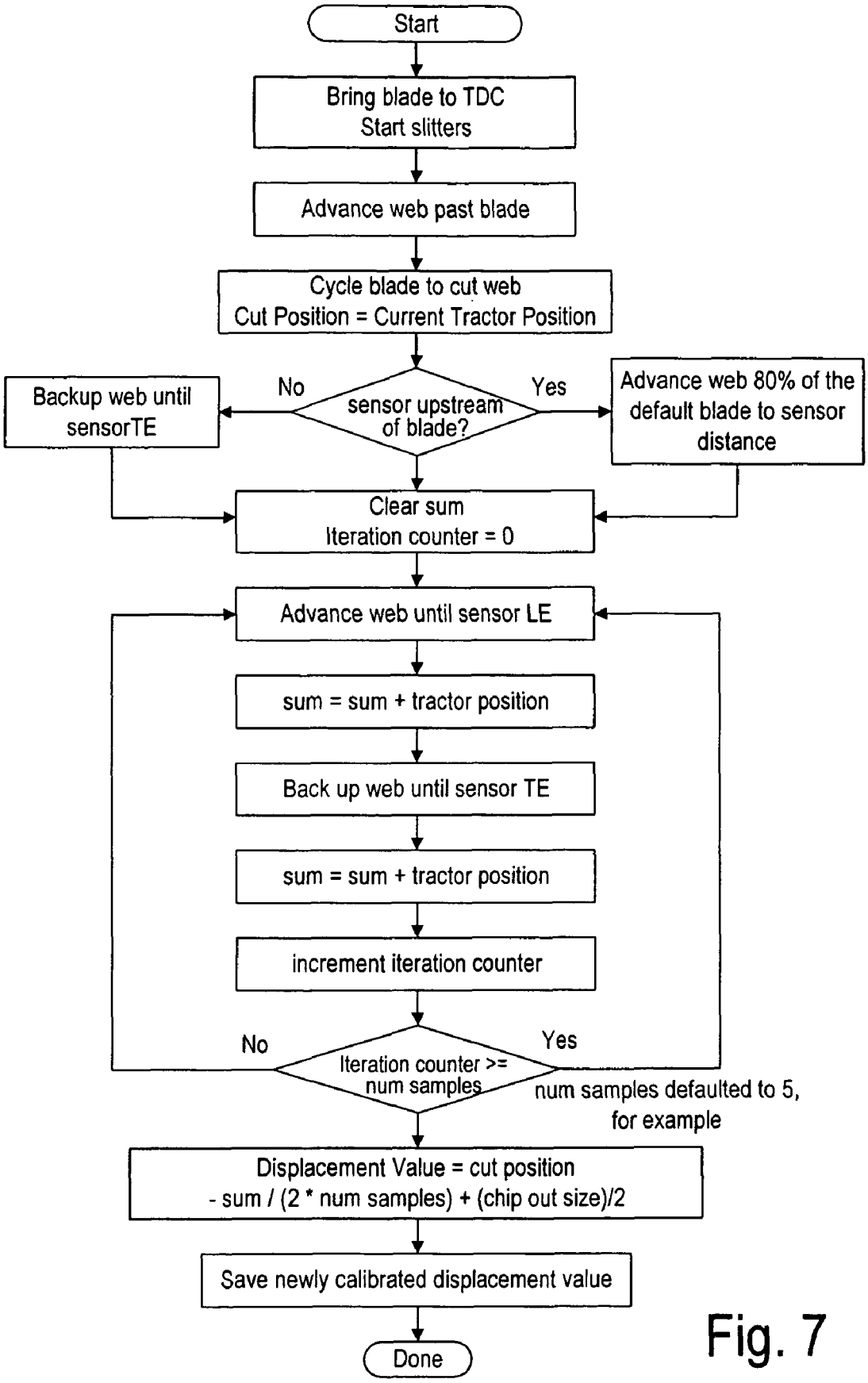
FIG. 7 is a flowchart illustrating the calibration procedure for setting up the datum for the motion control system that locates the web for subsequent cutting.

The above calibration procedure is further illustrated in the flowchart as shown in FIG. 7. As shown in FIG. 7, at the start of the calibration process, the chip-out blade is moved upward, if necessary, to provide a cleared paper path. The chip-out blade is usually operated in a rotary cycle of a motor and the upper-most position of the chip-out blade is generally referred to as the top-dead center (TDC). If the web cutter has a slitter or a cutting device to split the web into two-side-by portions (see FIG. 3), the slitter should also start its operation at this point. Likewise, if the web cutter has a pair of slitters or cutting devices to remove the side strips containing the sprocket holes (see FIG. 4), those slitters should also start their operation at this point. After the web is advanced past the chip-out blade, the blade is cycled once to cut the web. The encoder position of the web driver or tractor is recorded as the cut position. In the various steps as shown in the flowchart, sensor TE is the trail edge position of the web edge when it is sensed by the sensor 250 and sensor LE is the lead edge position of the web edge when it is sensed by the sensor 250. The tractor position is the encoder value at the sensor TE or LE. As illustrated in FIG. 7, the software program in the processor 270 also has an iteration counter to keep track of the forward and backward movement of the web in regard to the sensor 250 for averaging purposes. In a typical calibration procedure, the total number of sensor LE and sensor TE events is set to 5. However, this number can be smaller or greater than 5 depending on the accuracy desired. When the number of iterations has reached the pre-determined value, the calibrated displacement value for d1 or d2 is calculated based on the theoretical center of the sensor and the distance from this theoretical center to the center of the chip-out blade.

Figure 8:
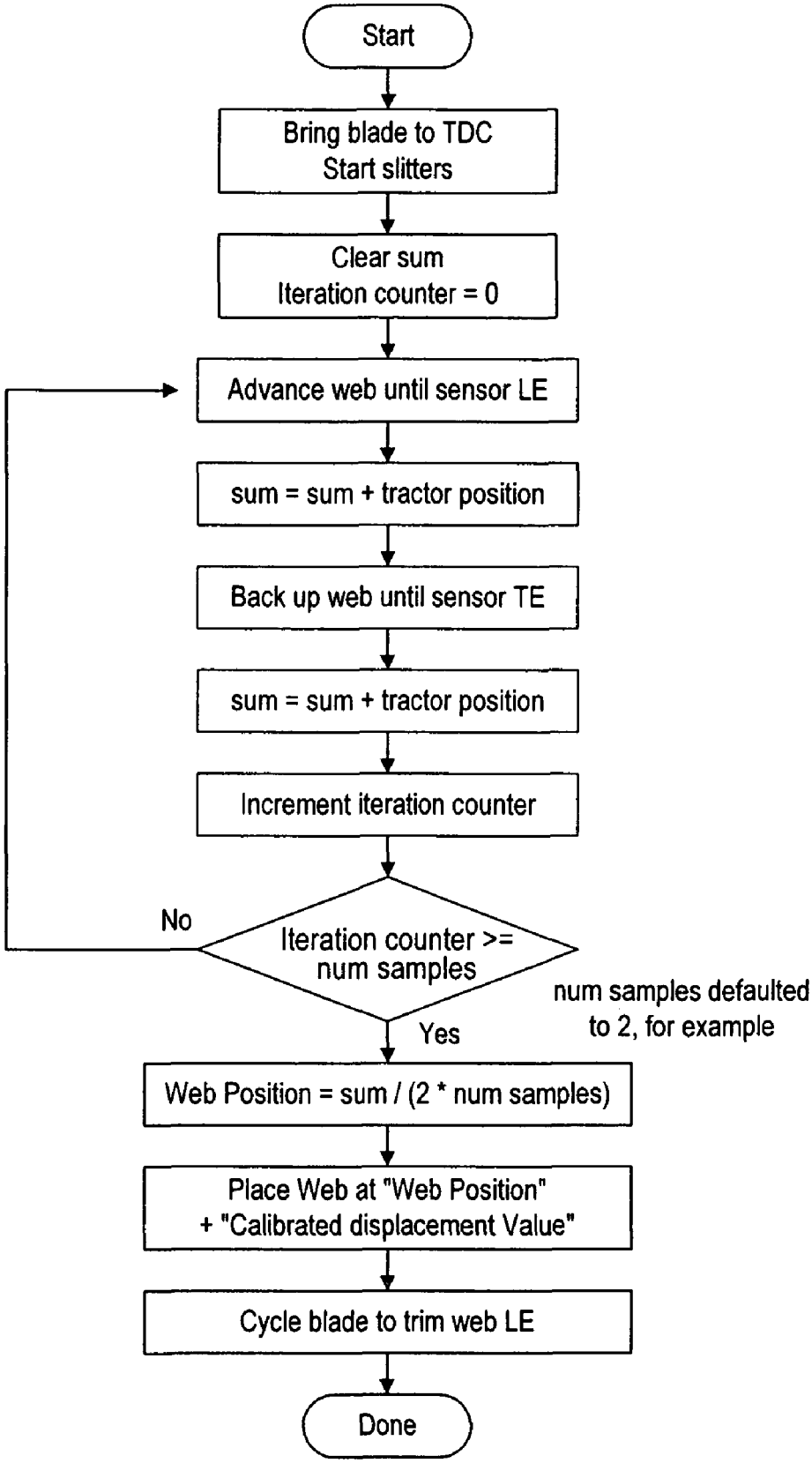
FIG. 8 is a flowchart illustrating the application procedure for use after loading the web after the calibration.

When loading the same or a new web, the calibrated displacement value can be used to position the web for cutting in reference to the theoretical center of the sensor 250. The web is first manually loaded onto a set of tractors (not shown) so as to allow the web driver to move the web toward downstream, with the web edge upstream of the sensor 250. The operator then instructs the cutter control system to execute a load procedure, causing the web driver to move the web edge toward the sensor. Once the edge reaches the sensor 250, the web edge is moved forward and backward around the sensor position a number of times so that the lead edge encoder values are latched and stored in the processor 270. Based on the stored encoder values, the processor computes the theoretical lead edge position of the web with respect to the sensor 250. The web can now be moved a distance according to the calibrated displacement value (d1 or d2) from the theoretical lead edge position of the web to ensure proper chip-out position. This application procedure is further illustrated in the flowchart as shown in FIG. 8. The theoretical lead edge position of the web is denoted as "Web Position" in FIG. 8. After the web edge is moved to the center of the blade according to the calculated displacement value relative to the theoretical lead edge position, the chip-out blade is cycled to trim the web edge.

The present invention provides a method and a system for calibrating a reference point with respect to the center of the chip-out blade without requiring an operation to visually find out wherein the center is. This reference point is established by a sensor 250, which is referred to as an introduction sensor. The displacement that the web driver needs to move from the introduction sensor to the center of the chip-out blade varies from cutter to cutter due to manufacturing tolerances. Thus, it is desirable or even necessary to perform the displacement calibration before a new cutter is used. Furthermore, any service operation on the web cutter may alter the physical displacement from the introduction sensor to the center of the chip-out blade. A re-calibration of the physical displacement is usually required. A manual re-calibration procedure requires the operator manually inputting the displacement values using trial and error methods to locate the cut correctly. The calibration procedure and the application procedure, according to the present invention, eliminate the need for manual re-calibration that not only takes time for the operator to accomplish but is also subject to error. The present invention increases the precision and accuracy of placement to perforation at the desired position for a chip-out operation.

Preferably, the photosensor is placed below the plane of the paper path of the web cutter so as to allow at least part of the light beam from the photosensor to be reflected back to the photosensor for sensing when the web is in the path of the light beam.

The reference point can be located upstream or downstream from the chip-out blade.

Although applications using chip-out blades are described within, the invention is not limited to perforated paper. The same methodology can be applied to paper that is not perforated, usually presented as roll stock. The only difference is that the lead edge presented to the cutter has a lead edge that is not perforated and is usually created by the operator using some type of clean edge device. However, the ⅛ inch chip-out application demands the most accuracy and precision due to its small size.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A method for determining a displacement distance of a web in a web cutter from a reference point to a blade for cutting the web into sheets at a desired chip-out position when the web is placed for movement on a paper plane, said method comprising:

providing a sensor at the reference point in relationship to the paper plane, wherein the sensor is operable in a first state and a second state;

advancing the web past the blade so as to allow the blade to cut the web for providing a web edge;

moving the web edge over the sensor in order to cause the sensor to change between the first and second states;

obtaining at least one position of the web edge when the sensor is caused to change the state by the web edge movement;

determining the displacement distance based on said at least one position in relation to a position of the web edge where the web is cut by the blade; and wherein the reference point is located upstream from the blade, and wherein said moving comprises pulling the web backward away from the blade.

2. The method of claim 1, wherein the sensor comprises a photosensor operable between the first state when a light beam from the photosensor is blocked by the web and the second state when the light beam is cleared from the web, and wherein said providing comprises placing the photosensor below the paper plane so as to allow at least part of the light beam to be reflected toward the photosensor for sensing when the light beam is blocked by the web.

3. The method of claim 1, wherein the web is provided from a fanfold stack of paper having a plurality of perforations for folding, said method further comprising the step of moving the blade for cutting out a portion of the web at each cut such that the portion contains one of the perforations.

4. A method for determining a displacement distance of a web in a web cutter from a reference point to a blade for cutting the web into sheets at a desired chip-out position when the web is placed for movement on a paper plane, said method comprising:

providing a sensor at the reference point in relationship to the paper plane, wherein the sensor is operable in a first state and a second state;

advancing the web past the blade so as to allow the blade to cut the web for providing a web edge;

moving the web edge over the sensor in order to cause the sensor to change between the first and second states; obtaining at least one position of the web edge when the sensor is caused to change the state by the web edge movement;

determining the displacement distance based on said at least one position in relation to a position of the web edge where the web is cut by the blade, wherein said at least one position comprises a plurality of positions of the web edge in relation to the position where the web is cut by the blade, and wherein said moving comprising a back-and-forth movement so as to cause the sensor to change the state by the web edge a number of times at said plurality of positions, and said determining comprising taking an average of said plurality of positions.

5. The method of claim 1 further including a step of performing a chip-out cut wherein the blade is a chip-out blade.

* * * * *